US006659516B2

(12) United States Patent
Wang et al.

(10) Patent No.: US 6,659,516 B2
(45) Date of Patent: Dec. 9, 2003

(54) LOCKING SYSTEM FOR A PORTABLE COMPUTER

(75) Inventors: Shyue-Yang Wang, Santa Clara, CA (US); John C. DiFonzo, Emerald Hill, CA (US); Daniele De Iuliis, San Francisco, CA (US); Andrew L. Johnston, Redwood City, CA (US)

(73) Assignee: Apple Computer, Inc., Cupertino, CA (US)

( * ) Notice: Subject to any disclaimer, the term of this patent is extended or adjusted under 35 U.S.C. 154(b) by 103 days.

(21) Appl. No.: 09/755,622

(22) Filed: Jan. 5, 2001

(65) Prior Publication Data

US 2002/0089190 A1 Jul. 11, 2002

(51) Int. Cl.[7] ..... E05C 3/04

(52) U.S. Cl. ..... 292/251.5; 292/202

(58) Field of Search ..... 292/251.5, 87, 292/80, 81, 89, 95, 114, 202

(56) References Cited

U.S. PATENT DOCUMENTS

| | | | | |
|---|---|---|---|---|
| 2,475,226 | A | * 7/1949 | Ellis | 24/201 |
| 2,735,740 | A | * 2/1956 | Soans | 312/234 |
| 3,658,370 | A | * 4/1972 | Wang | 292/201 |
| 4,363,403 | A | 12/1982 | Raucci, Jr. et al. | |
| 4,660,871 | A | 4/1987 | Arakawa et al. | |
| 4,901,261 | A | 2/1990 | Fuhs | |
| 4,964,661 | A | * 10/1990 | Cadwell | 292/87 |
| 4,982,303 | A | 1/1991 | Krenz | |
| 5,253,142 | A | 10/1993 | Weng | |
| 5,351,812 | A | * 10/1994 | Eagon | 206/1.7 |
| 5,409,275 | A | * 4/1995 | Yoshida | 292/251.5 |
| 5,466,166 | A | 11/1995 | Law et al. | |
| 5,488,522 | A | 1/1996 | Peace et al. | |
| 5,497,296 | A | 3/1996 | Satou et al. | |
| 5,510,953 | A | 4/1996 | Merkel | |
| 5,515,237 | A | 5/1996 | Ogami et al. | |
| 5,555,157 | A | 9/1996 | Moller et al. | |
| 5,574,625 | A | 11/1996 | Ohgami et al. | |
| 5,576,929 | A | 11/1996 | Uchiyama et al. | |
| 5,580,107 | A | * 12/1996 | Howell | 292/95 |
| 5,612,831 | A | 3/1997 | Gallo et al. | |
| 5,721,669 | A | 2/1998 | Becker et al. | |
| 5,737,185 | A | 4/1998 | Morrison et al. | |
| 5,740,012 | A | 4/1998 | Choi | |
| 5,809,520 | A | 9/1998 | Edwards et al. | |
| 5,812,370 | A | 9/1998 | Moore et al. | |
| 5,818,182 | A | 10/1998 | Viswanadham et al. | |
| 5,825,616 | A | 10/1998 | Howell et al. | |
| 5,841,631 | A | 11/1998 | Shin et al. | |
| 5,959,833 | A | 9/1999 | Youens | |
| 5,969,941 | A | 10/1999 | Cho | |
| 6,010,344 | A | 1/2000 | Muramatsu et al. | |
| 6,049,453 | A | 4/2000 | Hulsebosch | |
| 6,068,307 | A | 5/2000 | Murphy | |
| 6,115,239 | A | 9/2000 | Kim | |
| 6,129,395 | A | 10/2000 | Schlesener et al. | |
| 6,256,194 | B1 | 7/2001 | Choi et al. | |

* cited by examiner

*Primary Examiner*—Gary Estremsky
(74) *Attorney, Agent, or Firm*—Beyer Weaver & Thomas, LLP

(57) ABSTRACT

The invention generally pertains to a portable computer having a base and a lid. More particularly, the invention pertains to an improved locking system for securing the base relative to the lid. One aspect of the invention relates to a latch that is placed in a recess when the lid is opened so as to eliminate unsightly and harmful protrusions. Another aspect of the invention relates to a latch that is automatically extracted from the recess when the lid is closed so as to secure the lid to the base. For example, a magnetic actuator may be used to automatically extract the latch when the lid is closed. Yet another aspect of the invention relates to a button for releasing the secured latch so as to allow the lid to be opened.

22 Claims, 6 Drawing Sheets

LOCKING SYSTEM FOR A PORTABLE COMPUTER

BACKGROUND OF THE INVENTION

The present invention relates generally to a computing device. More particularly, the present invention relates to a locking system for use in a computing device.

Portable computers generally consist of a lid for housing a display screen and a base for carrying various internal and external components used for operating the portable computer. By way of example, the internal components may be a modem, a processor, a disk drive, memory and the like, and the external components may be a keyboard, a track pad, various buttons and the like. In most cases, the lid is hinged to the base so as to move the lid between a closed position, placing the lid against the base, and an open position, exposing the display screen and some of the external components such as the keyboard.

Most portable computers require that the lid be securely attached to the base for transportation. As such, a locking mechanism is generally provided to secure the lid to the base when the lid is in the closed position. The locking mechanism typically includes a protruding hook, which extends from the lid and which is configured for lockably engaging the base when the lid is in the closed position. The locking mechanism may also include a slide knob for slidably releasing the latch from the base so as to place the lid in the open position. By way of example, the latch may be configured to slide between an unlocked position, releasing the latch from the base, and a locked position, securing the latch to the base.

Unfortunately, in most portable computers, the latch extends or protrudes from the sides of the lid. Protrusions are not only unsightly, but also potentially dangerous. A protruding latch may result in the latches being accidentally sheared off when it comes into contact with some other object. Also, if the latch is accidentally slammed on a finger, or if the latch hooks on clothing, it can cause injury or damage, leaving a negative impression on the user. Furthermore, the release knob may be difficult to use, i.e., it generally requires two hands to operate.

Therefore, what is desired is a locking system that is easy to use, aesthetically pleasing, i.e., hidden from sight, and/or a locking mechanism that does not protrude from the portable computer when the lid is open.

SUMMARY OF THE INVENTION

The invention relates, in one embodiment, to a computer device. The computer device includes a base and a lid that is movable relative to the base. The computer device also includes a magnetic system for helping secure the lid relative to the base. In most embodiments, the magnetic system includes a magnetically actuated latch that is drawn into engagement with a portion of the base or the lid to secure the lid relative to the base.

The invention relates, in another embodiment, to a portable computer. The portable computer includes a base. The portable computer further includes a lid pivotally mounted to the base. The lid is movable between a closed position having the lid substantially flush with the base, and an open position having the lid away from the base. The portable computer also includes a securing system that holds the lid relative to the base when the lid is in the closed position. The securing system includes a base side locking mechanism and a lid side locking mechanism that are magnetically attracted to one another such that they lockably engage each other when the lid is positioned proximate the base.

The invention relates, in another embodiment, to a portable computer. The portable computer includes a base having a catch disposed therein. The catch is movable relative to the base. The portable computer further includes a lid pivotally mounted to the base. The lid is movable between a closed position, placing the lid substantially flush with the base, and an open position, placing the lid away from the base. The lid has a retractable latch disposed therein that is movable relative to the base. The retractable latch automatically moves between a first latch position, hiding the latch within the lid when the lid is moved to the open position, and a second latch position, engaging the catch when the lid is moved to the closed position. The catch moves between a first catch position, engaging the latch to prevent movement of the lid relative to the base, and a second catch position, releasing the latch therefrom to permit movement of the lid relative to the base.

The invention relates, in another embodiment, to a portable computer. The portable computer includes a base. The portable computer further includes a lid pivotally mounted to the base. The lid is movable between a closed position having the lid substantially flush with the base, and an open position having the lid away from the base. The portable computer also includes a securing system having a base side locking mechanism, a lid side locking mechanism and a button. The base side locking mechanism and a lid side locking mechanism are configured for engaging each other so as to hold the lid relative to the base when the lid is in the closed position. The button is configured for disengaging the base side locking mechanism and the lid side locking mechanism from one another so as to release the lid from the base.

BRIEF DESCRIPTION OF THE DRAWINGS

The invention may best be understood by reference to the following description taken in conjunction with the accompanying drawings in which.

DETAILED DESCRIPTION OF THE INVENTION

The invention generally pertains to a portable computer having a base and a lid. More particularly, the invention pertains to an improved locking system for securing the base relative to the lid. One aspect of the invention relates to a latch that is placed in a recess when the lid is opened so as to eliminate unsightly and harmful protrusions. Another aspect of the invention relates to a latch that is automatically extracted from the recess when the lid is closed so as to secure the lid to the base. In one embodiment, a magnetic actuator is used to automatically extract the latch when the lid is closed. Yet another aspect of the invention relates to a button for releasing the secured latch so as to allow the lid to be opened.

Embodiments of the invention are discussed below with reference to FIGS. 1–7. However, those skilled in the art will readily appreciate that the detailed description given herein with respect to these figures is for explanatory purposes as the invention extends beyond these limited embodiments.

Figure 1:
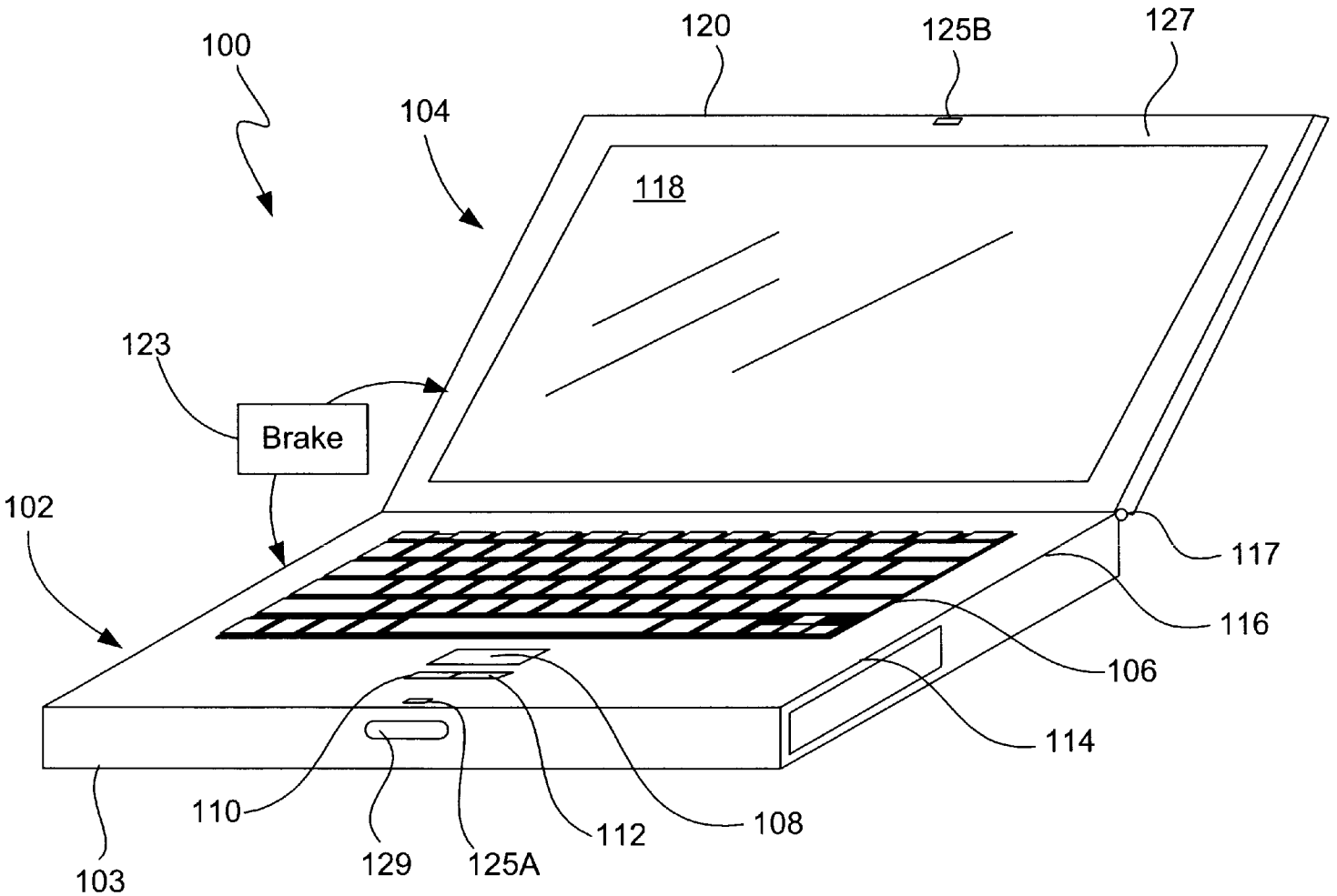
FIG. 1 is a perspective diagram of a portable computer, in accordance with one embodiment of the present invention.

FIG. 1 is a perspective diagram of a portable computer 100, in accordance with one embodiment of the invention. The portable computer 100 generally consists of a base 102 for carrying various internal and external components used for operating the portable computer 100 and a lid 104 for housing a display screen. More particularly, the base 102 includes a casing 103 for internally enclosing various integrated circuit chips and other circuitry that provide computing operations for the portable computer 100. By way of example, the integrated circuit chips and other circuitry may include a microprocessor, Read-Only Memory (ROM), Random-Access Memory (RAM), a disk drive, a battery, and various input/output support devices.

The base 102 also includes a plurality of external input devices such as a keyboard 106, a track pad 108 and buttons 110 & 112. The keyboard 106 allows a user of the portable computer 100 to enter alphanumeric data, the track pad 108 allows a user to move an input pointer on a graphical user interface, and the buttons 110 and 112 allow a user to make a selection on the graphical user interface. As shown, the track pad 108 and buttons 110 & 112 are disposed in a front portion 114 of the casing 103, and the keyboard 106 is disposed in a back portion 116 of the casing 103. Furthermore, the lid 104 includes a liquid crystal display (LCD) 118 that is used to display the graphical user interface (including perhaps the input pointer or alphanumeric data) as well as other information to the user. The LCD display 118 is generally surrounded at a peripheral region by a bezel 120 that serves to support the LCD display 118 in its assembled position within the lid 104.

Figure 3:
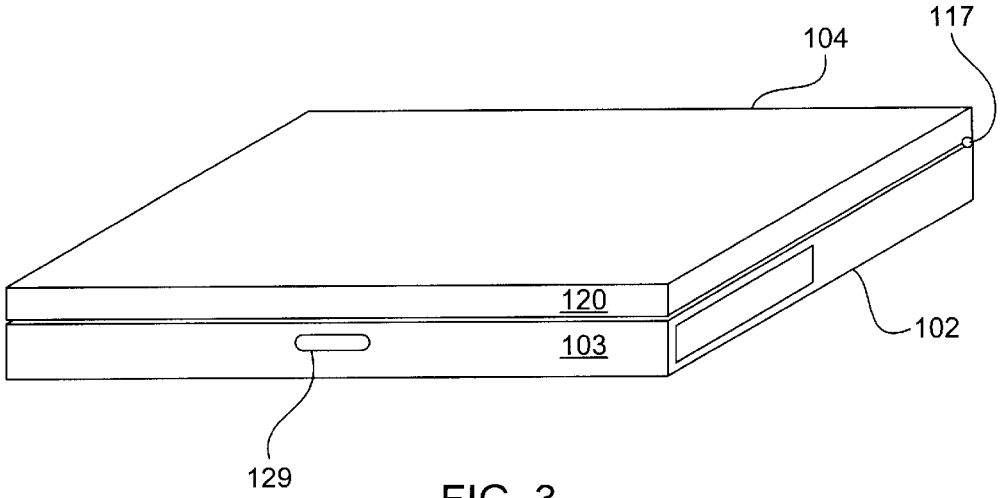
FIG. 3 is a perspective diagram of a portable computer in a closed open position, in accordance with one embodiment of the present invention.
Figure 2:
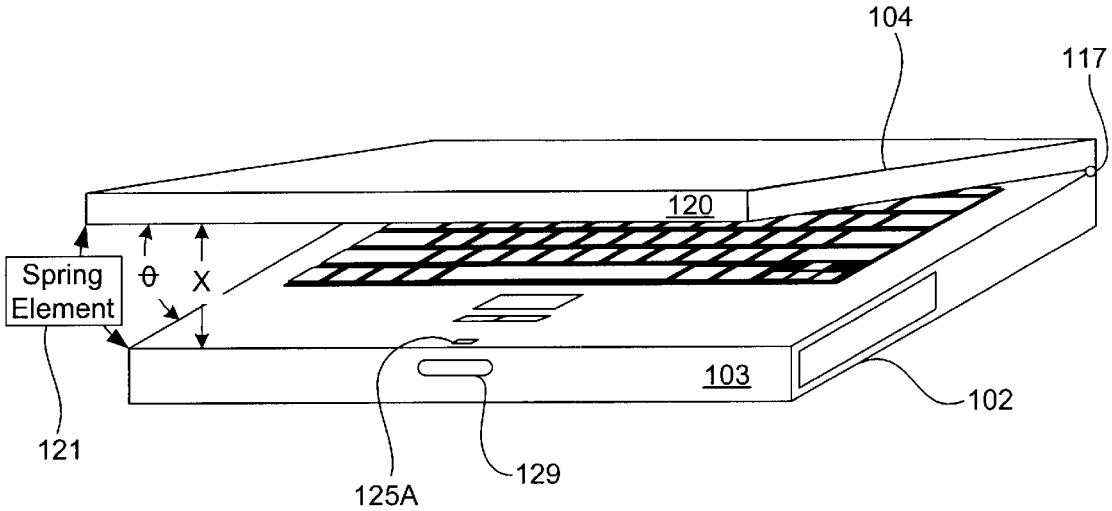
FIG. 2 is a perspective diagram of a portable computer in a partially open position, in accordance with one embodiment of the present invention.

Referring to FIGS. 1–3, the lid 104 is pivotably mounted to the base 102 via a hinge mechanism 117. The hinge mechanism 117 generally allows the lid 104 to pivot relative to the base 102 so as to adjust the orientation of the lid 104 relative to the base 102. For example, the lid 104 may rotate into an open position (as shown in FIG. 1), a partially open position (as shown in FIG. 2), or a closed position (as shown in FIG. 3). In general, the open position corresponds to a lid orientation that allows a user to use the portable computer, i.e., the LCD display 118 and input devices 106–112 are visible and accessible to a user, the partially open position corresponds to a lid orientation that allows a user to grasp the lid for movement between the open and closed positions, i.e., there is sufficient space between the lid and the base for lifting the lid with a finger, and the closed position corresponds to a lid orientation that allows a user to store or transport the portable computer, i.e., the base and lid are substantially flush with one another such that the LCD 118 and the input devices 106–112 are no longer visible or accessible to a user.

A locking mechanism 125 is also provided for securing the lid 104 to the base 102 when the lid 104 is in the closed position (FIG. 3). The locking mechanism 125 generally consists of two parts, a base side locking mechanism 125A and a lid side locking mechanism 125B. As shown, the base side locking mechanism 125A is located in the front portion 114 of the casing 103 (in front of the track pad 108) and the lid side locking mechanism 125B is located in a top portion 127 of the bezel 120. Furthermore, the base side locking mechanism 125A and the lid side locking mechanism 125B are cooperatively positioned so that when the lid 104 is closed, the locking mechanisms 125 lockably engage with one another thus securing the lid 104 to the base 102. The locking mechanism 125 also includes a knob or switch 129 for releasing the base side locking mechanism 125A from the lid side locking mechanism 125B so as to allow the lid 104 to be opened.

In one embodiment, the locking mechanism 125 is arranged to be hidden from view when the lid 104 is opened (FIGS. 1 & 2), and more particularly when the lid 104 is moved away from the base 102. In another embodiment, the locking mechanisms 125 A & B are configured to automatically engage one another when the lid 104 is closed (FIG. 3), and more particularly when the lid 104 is moved proximate the base 102. In another embodiment, a button is used to release the locking mechanisms 125 A & B from one another so as to allow movement of the lid 104 relative to the base 102, i.e., the lid may be opened. The locking mechanism 125, including these embodiments, will be described in greater detail below.

Referring back to the hinge mechanism 117, the hinge mechanism 117 is configured to automatically position the lid 104 in the partially open position (FIG. 2) when the lid 104 is not secured to the base 102, for example, when the lid side locking mechanism 125B is released from the base side locking mechanism 125A. In one implementation, the hinge mechanism 117 includes a spring element 121 (shown in FIG. 2) configured for continuously exerting a biasing force on the lid 104 in a direction away from the base 102. Byway of example, a torsion spring having one end connected to the base and another end connected to the lid may be used to create the biasing force. Furthermore, the force provided by the spring element 121 is configured to move the lid 104 a predetermined distance X (or a predetermined angle $\theta$) away from the base 102. The predetermined distance (or angle) is preferably configured to provide an edge of the lid 104 to a user so that the user can easily grasp the lid 104 without difficulty when moving the lid to its open position (FIG. 1). By way of example, a predetermined angle of about 5 degrees to about 15 degrees may be used.

In addition, the hinge mechanism 117 is configured to hold the lid 104 in the open position (FIG. 1) when the lid is moved there from the partially open position (FIG. 2). Byway of example, after the lid 104 has moved to the partially open position via the spring element 121 (FIG. 2) the user typically lifts the lid 104 to the open position (FIG. 1) so as to use the portable computer 100. In one implementation, the hinge mechanism 117 includes a brake 123 (shown in FIG. 1) configured for exerting a frictional force an the lid 104 so as to maintain the position of the lid 104 when the lid 104 is moved to the desired open position. By way of example, a cam may be used to create the frictional force. In general, the cam moves between an engagement position, preventing the lid from slipping out of position, and a release position, allowing the lid to freely rotate around the pivot. In most cases, the engagement position corresponds to a range of positions between the partially open position and some maximum open position, and the release position corresponds to a range of positions between the closed position and the partially open position.

To open the closed portable computer 100 (FIG. 3), the user first actuates the lock release switch 129 to release the lid side locking mechanism 125B from the body side locking mechanism 125A. Alter the locking mechanisms 125A & B are released, the lid 104 automatically moves from the closed position (FIG. 3) to the partially open position (FIG. 2) via the spring element 121 of the hinge mechanism 117. After the lid 104 has reached the partially open position (FIG. 2), the user moves the lid 104 from the partially open position (FIG. 2) to the open position (FIG. 1). This is typically accomplished by lifting the lid 104 with a finger.

To close the opened portable computer 100 (FIG. 1), the user moves the lid from the open position (FIG. 1) to the closed position (FIG. 3) so as to position the locking mechanisms 125A & B proximate each other, thus enabling them to lockably engage. This is typically accomplished by pressing down on the lid 104 with a finger to overcome the braking force used to hold the lid 104 in place and the biasing force used to partially open the lid 104.

Figure 4:
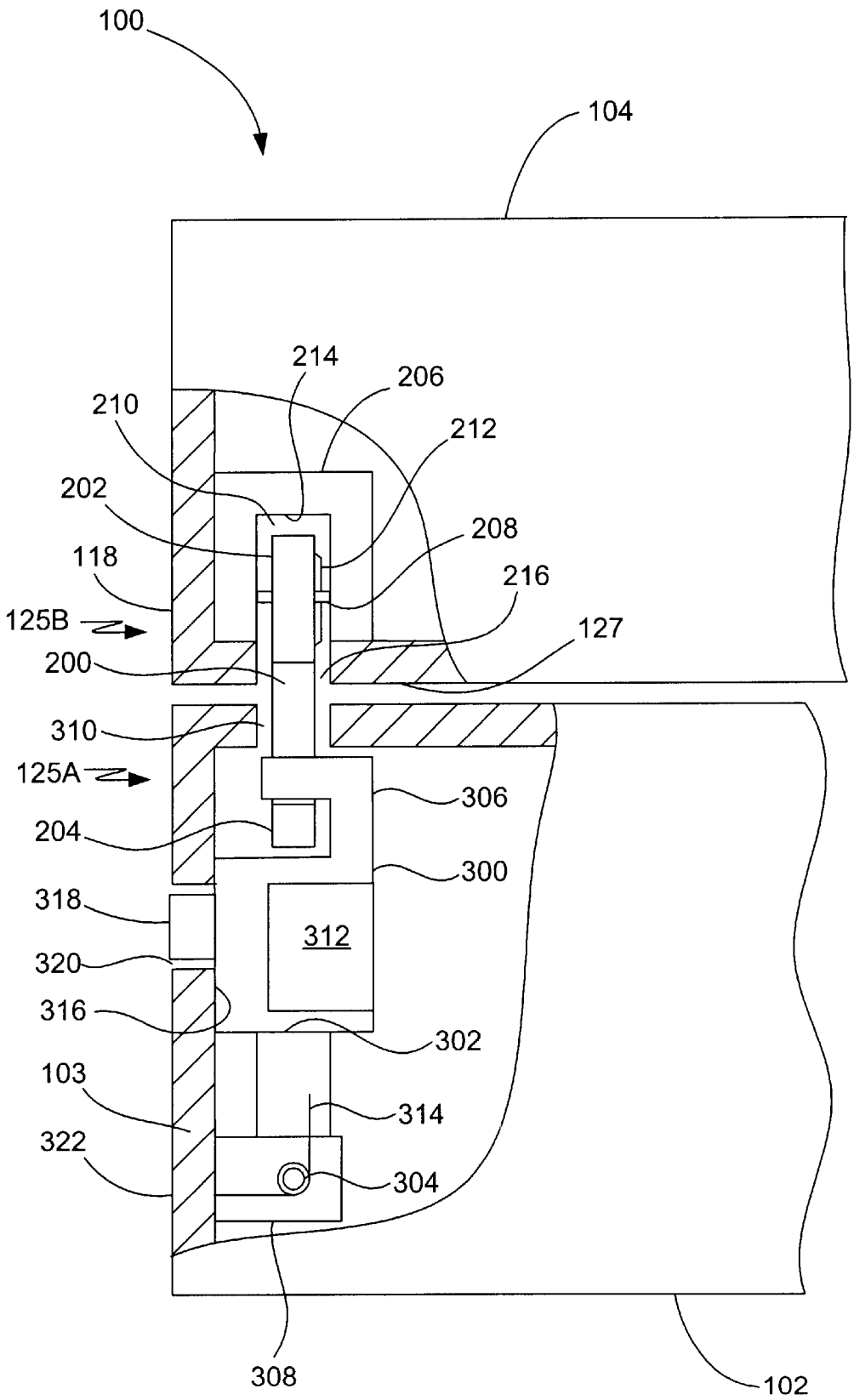
FIG. 4 is a partial cut away side elevation view, in cross section, of the portable computer in a closed position, in accordance with one embodiment of the present invention.
Figure 5:
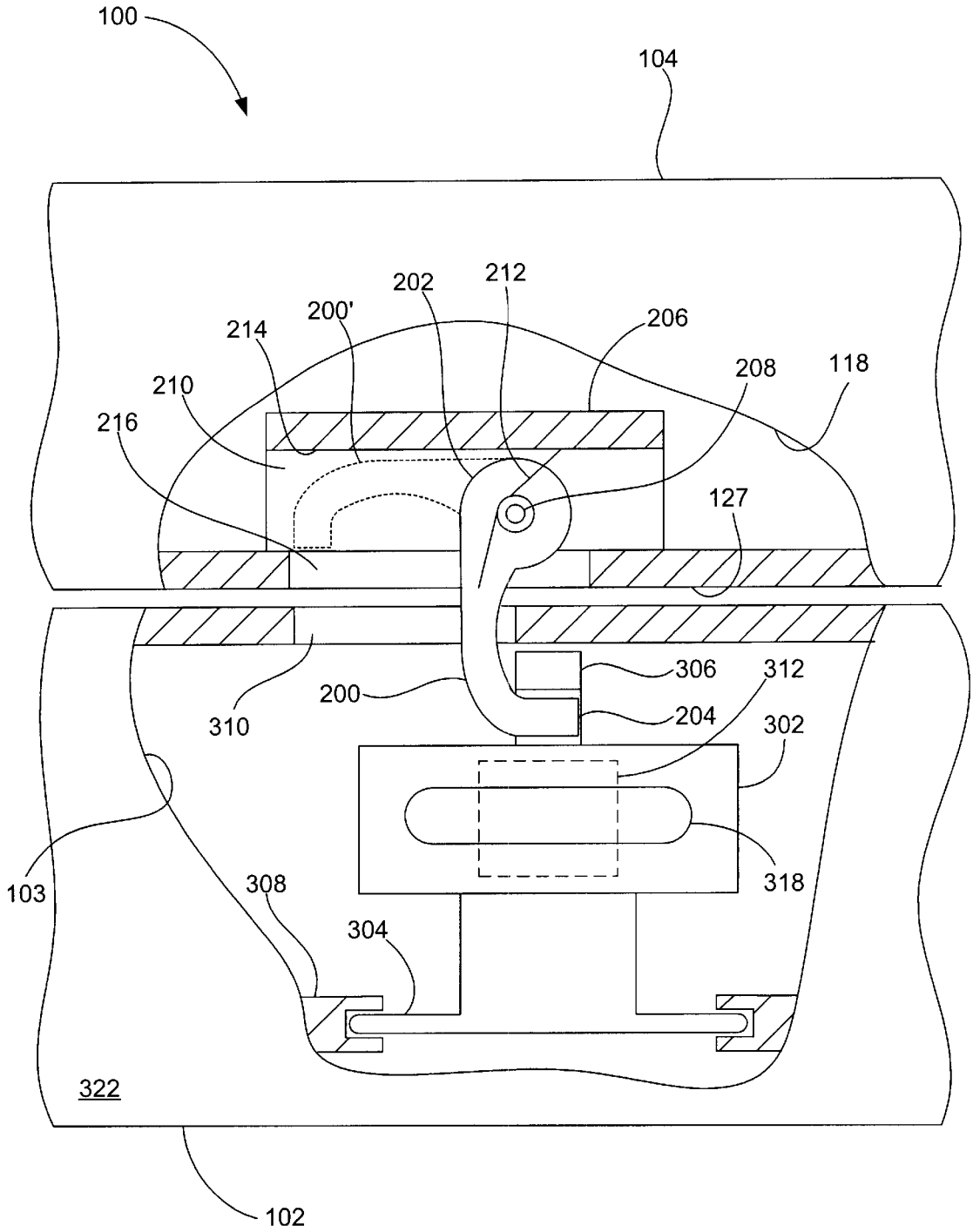
FIG. 5 is a partial cut away front view, in cross section of the portable computer in a closed position, in accordance with one embodiment of the present invention.
Figure 6:
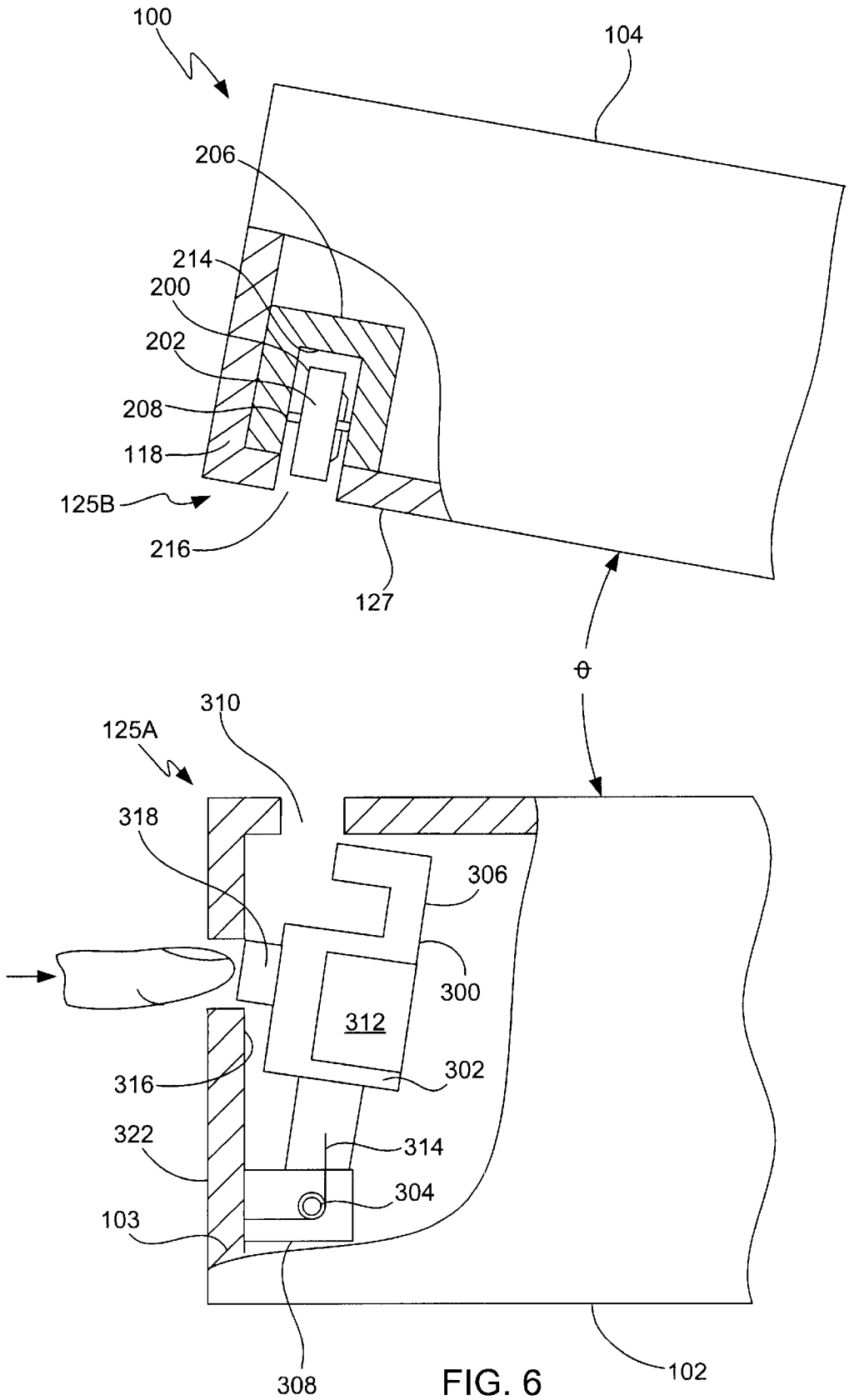
FIG. 6 is a partial cut away side elevation view, in cross section, of the portable computer in an open position, in accordance with one embodiment of the present invention.
Figure 7:
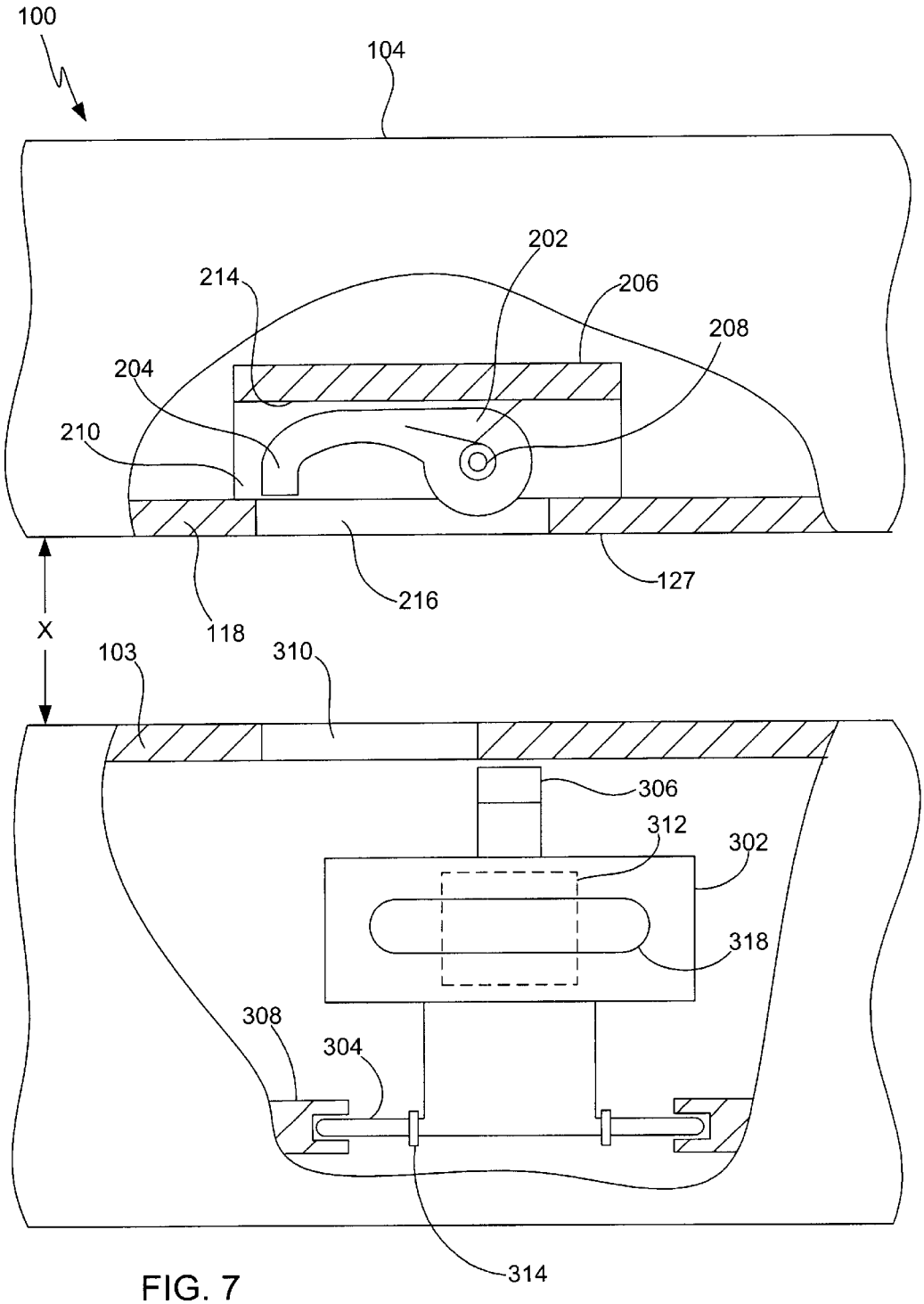
FIG. 7 is a partial cut away front view, in cross section of the portable computer in an open position, in accordance with one embodiment of the present invention.

Referring now to FIGS. 4–7, the locking mechanism 125 will be described in greater detail. As should be appreciated, portions of the lid 104 and the base 102 have been cut away in these figures to show the inner workings of the locking mechanism 125. For example, FIG. 4 is a partial cut away side elevation view, in cross section, of the portable computer in its closed position, FIG. 5 is a partial cut away front view, in cross section of the portable computer in its closed position, FIG. 6 is a partial cut away side elevation view, in cross section, of the portable computer in its partially open position, and FIG. 7 is a partial cut away front view, in cross section of the portable computer in its partially open position.

As shown, the lid side locking mechanism 125B includes a latch 200 and the body side locking mechanism 125A includes a catch 300. Broadly, the latch 200 and the catch 300 work together to hold the lid 104 relative to the base 102 when the lid 104 is closed and to release the lid 104 from the base 102 when the lid 104 is desired to be opened. In most cases, the latch 200 is movable relative to the lid 104, and the catch 300 is movable relative to the base 102. More specifically, the latch 200 is configured to move between a first latch position, storing the latch 200 when the lid is opened (FIGS. 6 & 7), and a second latch position, engaging the catch 300 when the lid 104 is closed (FIGS. 4 & 5). In addition, the catch 300 is configured to move between a first catch position, engaging the latch 200 to prevent movement of the lid 104 relative to the base 102 (FIGS. 4 & 5), and a second catch position, releasing the latch 200 to permit movement of the lid 104 relative to the base 102 (FIGS. 6 & 7 The latch 200 generally includes a latch body 202 and a hook 204. The hook 204 extends from the latch body 202, and is arranged for engaging the catch 300 when the lid 104 is closed and when the latch 200 is in the second latch position. In the illustrated embodiment, the latch body 202 is pivotally mounted to the lid 104, and more particularly to the bezel 118. This is generally accomplished via a support structure that includes a latch frame 206 and a pivot pin 208. As shown, the pivot pin 208 is structurally coupled to the latch frame 206, and the latch body 202 is rotatably coupled to the pivot pin 208 via a through hole (not shown). The latch frame 206 may be attached directly or indirectly to the bezel 118. By way of example, the latch frame 206 may be attached to the inner surface of the bezel (as shown) or to a bezel frame. Alternatively, the latch frame 206 may be formed from the bezel 118 itself.

Furthermore, the support structure, i.e., the latch frame 206 and pivot pin 208, is disposed inside a recess 210 of the bezel 118. As such, the latch 200 is configured to rotate between a retracted position, placing the latch 200 inside the bezel 118 so as to hide it from view, and an extracted position, placing the latch 200 outside the bezel 118 for engagement with the catch 300. In the illustrated embodiment, the retracted position places the entire latch 200 inside the bezel 118 (e.g., behind the top surface 127), and the extracted position places the hook 204 outside the bezel 118. The retracted position of latch 200 is shown by dotted lines 200' in FIG. 5. As should be appreciated, the retracted position and the extracted position generally correspond to the first latch position and second latch position, respectively, as described above.

As should be appreciated, the latch 200 is rotated to the retracted position when the lid 104 is moved away from the base 102 so as to eliminate unsightly and harmful protrusions. By way of example, the latch 200 may retract when the lid 104 is moved from the closed position to the partially open position, and stay retracted in both the partially open position and the open position as well as any positions therebetween. That is, the latch 200 does not protrude from the portable computer when the lid is opened (FIGS. 6 & 7).

In one embodiment, a spring element 212 is used to continuously exert a biasing force on the latch 200 so as to place the latch 200 in the retracted position, and thus into the recess 210 of the bezel 118. That is, the spring element 212 is configured to hold the latch 200 in the recess 210. In this embodiment, the spring element 212 causes the latch 200 to rotate about the pivot pin 208 until it reaches a stop surface 214 that determines the retracted position (or the first latch position). In the illustrated embodiment, the stop surface 214 is a portion of the latch frame 206, however, it should be noted that this is not a limitation and that the stop surface may vary according to the specific design of the latch assembly. By way of example, the stop surface 214 may be a portion of the bezel frame or a portion of the bezel itself.

Because of space limitations in portable computers, the spring element 212 is preferably a torsion spring. The torsion spring generally has one end connected to the latch frame 206 and another end connected to the latch 200. As such, the torsion spring exerts a force on the latch 200 relative to the latch frame 206 and thus the latch 200 is forced towards the stop surface 214. It should be noted, however, that torsion springs are not a limitation and that other types of springs may be used. By way of example, compression and tension type springs may also be used. It should also be noted that the spring element is not limited to springs and that other mechanisms may be used to continuously force the latch 200 into the retracted position.

Moreover, the latch 200 generally rotates through an opening 216 in the bezel 118. The opening 216 is arranged to allow movement of the latch 202, and more particularly the hook 204, from the retracted position to the extracted position and vice versa. The hook 204 generally has a length that allows it to extend through the opening 216 to engage the catch 300 when the lid 104 is in the closed position. In the illustrated embodiment, the opening 216 is in the form of a slot, where the length is greater than the width. As should be appreciated, the width of the slot is configured to be slightly larger than the width of the latch 200 to allow free movement without impediments. Additionally, the length is configured to be slightly larger than the swinging path of the latch 200 to allow the latch 200 to move back and forth between positions without impediments. Although the hook 204 is shown as being in the same plane as the body, it should be noted that in some embodiments, the hook 204 may be offset from the body 202, and thus the body 202 may not be accessible through the opening 216, i.e., the body 202 may be disposed behind the bezel wall 127.

In one embodiment, a magnetic element 312 is used to exert a force on the latch 200 when the lid 104 is closed so as to place the latch 200 in the extracted position, and thus into engagement with the catch 300. In the illustrated embodiment, the magnetic element 312 is positioned within the base 102, and more particularly within the catch 300. As such, when the lid 104 is proximate the base 102, as for example when a user pushes the lid 104 from the open position to the closed position, the magnetic element 312 magnetically draws the latch 200 towards the catch 300 thus clamping the lid 104 to the base 102. For example, the magnetic element 312 causes the latch 200 to rotate about the pivot pin 208 until the hook 204 engages the catch 300. Once engaged, the latch/catch connection works against the forces of the hinge mechanism 117 to prevent the lid 104 from moving to the partially open position. As should be appreciated, the magnetic force exerted by the magnetic element 312 is configured to work against the spring force generated by the spring element 212. The latch 200 is generally formed from a suitable magnetically attractive material such as steel.

The catch 300 generally includes a catch body 302, a pivot arm 304, and a flange 306. The flange 306 extends from the catch body 302, and is arranged for receiving the latch 200 when the lid 104 is closed and when the latch 200 is in the second latch position (or extracted position). In the illustrated embodiment, the catch body 302 is pivotally mounted to the base 102, and more particularly to the casing 103. This is generally accomplished via the pivot bar 304, which is seated in a catch frame 308 thus enabling the catch 300 to rotate. The catch frame 308 may be attached directly or indirectly to the casing 103. By way of example, the catch frame 308 may be attached to the inner surface of the casing (as shown) or to a casing frame. Alternatively, the catch frame 308 may be formed from the casing 118 itself.

The catch 300 is generally disposed inside the casing 103 of the base 102. Further, the catch 300, and more particularly the flange 306, is generally positioned below an opening 310 in the casing 103. The catch opening 310 is cooperatively positioned with the latch opening 216 so as to provide a through way where the hook 204 of the latch 200 can rotate to engage the flange 306 of the catch 300, for example, when the lid 104 is closed and the latch 200 is in the extracted position. In the illustrated embodiment, the opening 310 is in the form of a slot, where the length is greater than the width. As should be appreciated, the width of the slot is configured to be slightly larger than the width of the latch 200 to allow free movement without impediments. Additionally, the length is configured to be slightly larger than the swinging path of the latch to allow the latch to move back and forth between positions without impediments.

The catch 300 is configured to rotate between a latch receiving position, placing the catch 300 (e.g., flange) in alignment with the opening 310 for engagement with the latch 200 (e.g., hook), and a latch releasing position, placing the catch 300 (e.g., flange) away from the opening 310 for disengagement from the latch 200 (e.g., hook). In most cases, the catch 300 is biased in the latch receiving position so that when the lid 104 is closed, the magnetic element 312 can pull the latch 200 into engagement with the catch 300 thus securing the lid 104 to the base 102. Conversely, when the catch 300 is moved to the latch releasing position, the latch 200 is released therefrom, and the lid 104 is left unsecured relative to the base 102. Once unsecured, the lid 104 is raised via the hinge mechanism 117 where after the lid 104 has risen a small distance, the latch 200 moves away from the magnet element 312 and the spring element 212, working against the weakening magnetic force, returns the latch to the recess 216. As should be appreciated, the latch receiving position and the latch releasing position generally correspond to the first catch position and second catch position, respectively, as described above.

With regards to the magnetic element 312, the magnetic element 312 is disposed inside a cavity in the catch body 302. As mentioned, the magnetic element 312 is arranged for pulling the latch 200 out of its retracted position when the lid 104 is proximate the base 102 so that the hook 204 of the latch 200 can engage the flange 306 of the catch 300. Once engaged, the hook/flange connection overcomes the biasing force created by the hinge mechanism 117 and thus the lid 104 is secured to the base 102. In the illustrated embodiment, the magnet element 312 is a permanent magnet that is press fit into the cavity, which is located in the backside of the catch body 302. The magnetic force generated by the permanent magnet is preferably configured to overcome the spring force exerted by the spring element. The magnetic force generally depends on several factors including the strength and size of the magnet. It should be noted that the size and shape may vary according to the specific needs of each assembly. For example, the magnets are not limited to rectangular shapes and thus they may be formed from almost any geometric configuration, i.e., cylindrical. It should also be noted, that the invention is not limited to permanent magnets and that other types of magnetic elements may be used, i.e., electromagnets.

In one embodiment, a spring element 314 is used to continuously exert a biasing force on the catch 300 so as to place the catch 300 in the locked position for receiving an extracted latch 200. That is, the spring element 314 is configured to hold the catch 300 under the opening 310. In this embodiment, the spring element 314 causes the catch 300 to rotate about the pivot axis until it reaches a stop surface 316 that determines the latch receiving position (or the first catch position). In the illustrated embodiment, the stop surface 316 is an inner portion of the casing 103, however, it should be noted that this is not a limitation and that the stop surface may vary according to the specific design of the catch assembly. By way of example, the stop surface 316 may be a portion of the casing frame or a portion of the catch frame.

Because of space limitations in portable computers, the spring element 314 is preferably a torsion spring. The torsion spring generally has one end connected to the catch frame 308 (or casing 103) and another end connected to the catch 300. As such, the torsion spring exerts a force on the catch 300 relative to the catch frame 308 and thus the catch 300 is forced towards the stop surface 316. It should be noted that torsion springs are not a limitation and that other types of springs may be used. By way of example, compression and tension type springs may also be used. It should also be noted that the spring element is not limited to springs and that other mechanisms may be used to continuously force the catch 300 into the latch receiving position.

The catch 300 also includes a release button 318 for freeing the lid 104 from the base 102 when the lid 104 and base 102 are locked via the hook/flange connection. By way of example, the button 318 may respectively correspond to the release knob 129 illustrated in FIGS. 1–3. In particular, the release button allows a user to simply move the catch 300 from the latch receiving position (FIG. 4) to the latch releasing position (FIG. 6). As mention, the latch receiving position places the catch 300 in a position to receive the magnetically extracted latch 200, and the latch releasing position places the catch 300 in a position spaced apart from the magnetically extracted latch 200. Further, the latch receiving position gives the hook 204 the ability to engage the flange 306 when the lid 104 is closed, and the latch releasing position gives the flange 306 the ability to disengage the hook 204 therefrom when the lid 104 is desired to be opened.

The release button 318 generally protrudes from the side of the catch body 302 and extends into a hole 320 configured for receiving the button 318. In fact, the inner peripheral surface of the hole 320 is generally configured to coincide with the outer peripheral surface of the button 318 so that the button 318 can move with ease therethrough. In most cases, the button 318 extends from one side of the hole 320 to the other side of the hole 320 so that a user can easily depress the button 318 with a finger. The button 318 is generally held in the hole 320 via the same spring force that places the catch 300 in the latch receiving position. As such, when a user pushes the button 318 (as shown in FIG. 7), the button 318 moves partially through the hole 320 against the spring force thus causing the catch body 302 to rotate about the pivot. In the illustrated embodiment, the button 318 has an oblong shape and the hole 320 is disposed in the front side 322 of the casing 103. It should be noted, however, that these are not limitations and that the button can be formed from any shape and that the hole can be positioned in other areas of the casing.

Accordingly, to open the lid 104, the user pushes the button 318 so as to release the hook 204 from the flange 306. That is, when the button 318 is depressed, the flange 306 moves away from the hook 204 thus releasing the latch 200 from the catch 300. After the hook 204 is released, the torque created by the hinge mechanism 117 moves the lid 104 to the partially open position. That is, the lid 104 pops up to the partially open position (X or theta) under the biasing force of the hinge mechanism 117. In most situations, the magnetic force is still applied to the latch 200 and therefore the biasing force is arranged to be greater than the magnetic force created by the magnetic element 312. It is also important that the lid 104 raise to the predetermined distance X (or theta) so that latch gets out of the magnetic influence of the magnetic element 312. As should be appreciated, the magnetic force is strong enough to pull the latch 200 down, but not strong enough to pull the entire lid 104 down. Alternatively, a user may move the lid 104 from the closed to partially open position. As the lid 104 moves to the partially open position, the magnetic force holding the latch 200 in the extracted position weakens and thus the latch 200 moves to the retracted position under the force of the spring element 212. That is, once the magnetic force no longer interacts, the spring force pulls the latch 200 into the bezel 118. As such, the computer surfaces are substantially flush and free of protrusions during use of the computer.

To close the lid 104, the user pushes down on the lid 104 to place the interior of the lid 104 next to the interior of the base 102. As the lid 104 is lowered, the magnetic element 312 in the base 102 pulls the hook 204 out of the bezel to a point where it can engage the flange 306. Once engaged, the hook/flange connection works against the torque of the hinge mechanism 117 to hold the lid 104 relative to the base 102, i.e., closed.

As can be seen from the foregoing, the advantages of the invention are numerous. Different embodiments or implementations may have one or more of the following advantages. One advantage of the invention is that the locking system does not leave a negative impression on the user, i.e., aesthetically pleasing and tends not to cause injury or damage. Another advantage of the invention is that the locking system is easy to use. For example, the lid can be opened and closed with one hand via the release button and the automatic engagement of the latch and the catch, respectively. Another advantage of the invention is that the locking system allows for a very thin lid. As should be appreciated, the trend in portable devices is thinner and lighter.

While this invention has been described in terms of several preferred embodiments, there are alterations, permutations, and equivalents, which fall within the scope of this invention. For example, the locations of the latch and catch assemblies may be reversed such that the catch is located in the lid and the latch is located in the base. Further, the latch and catch assemblies may be positioned so that they are disposed on the edge of the portable computer rather than in the middle. Further still, a plurality of locking mechanisms may be used where a first locking mechanism is positioned at a first edge and a second locking mechanism is positioned at a second edge. In addition, although the catch assembly is shown and described as being a pivoting structure, it should be noted that this is not a limitation and that other types of linkages may be used. For example, the catch assembly may be configured as a slide linkage, flexure, and the like. Moreover, although the magnets were described as being disposed in the catch, it should be understood that this is not a limitation and that the magnets may be disposed anywhere underneath the casing (so long as the magnetically attract the latch to the catch). It should also be noted that there are many alternative ways of implementing the methods and apparatuses of the present invention. It is therefore intended that the following appended claims be interpreted as including all such alterations, permutations, and equivalents as fall within the true spirit and scope of the present invention.

What is claimed is:

1. A computer device, comprising:

a first housing;

a second housing movable relative to the first housing; and a locking system for mechanically securing the second housing relative to the first housing, the locking system including a retractable latch that is movable relative to the second housing and that is magnetically forced into clasping engagement with a portion or component of the first housing to mechanically secure the second housing relative to the first housing, the retractable latch moving between a first latch position, placing the latch in its entirety within the second housing, and a second latch position, placing a portion of the latch outside the second housing, wherein when the retractable latch is in the second latch position, the retractable latch is engaged with the portion or component of the first housing to mechanically secure the second housing relative to the first housing.

2. The device as recited in claim 1 wherein the locking system includes a catch that is movable relative to the first housing, the latch being magnetically forced into clasping engagement with the catch to mechanically secure the second housing relative to the first housing.

3. The device as recited in claim 1 wherein the locking system includes a magnetic element disposed within the first housing, the magnetic element being configured to magnetically draw the latch into clasping engagement with the portion or component of the first housing to mechanically secure the second housing relative to the first housing.

4. The device as recited in claim 3 wherein the locking system includes a catch that is movable relative to the first housing, the magnetic element being configured to magnetically draw the latch of the second housing into clasping engagement with the catch of the first housing to mechanically secure the second housing relative to the first housing.

5. The device as recited in claim 4 wherein the catch is disposed in its entirety within the first housing.

6. A portable computer comprising:

a base;

a lid pivotally mounted to the base, the lid being movable between a closed position having the lid substantially flush with the base, and an open position having the lid away from the base; and a securing system that holds the lid relative to the base when the lid is in the closed position, the securing system including a base side locking mechanism and a lid side locking mechanism that are magnetically attracted to one another such that they lockably engage each other when the lid is positioned proximate the base, the base side locking mechanism including a button for releasing the locking mechanisms from engagement.

7. The portable computer as recited in claim 6 wherein the lid side locking mechanism is hidden within the lid when the lid is in the open position, and wherein the base side locking mechanism is hidden within the base when the lid is in the open position.

8. The portable computer as recited in claim 7 wherein the lid is pivotally mounted to the base via a hinge mechanism, the hinge mechanism being configured for automatically positioning the lid in a partially open position when the lid is free from the base, and for holding the lid in a more fully opened position when the lid is further opened from the partially open position.

9. The portable computer as recited in claim 8 wherein the hinge mechanism includes a spring element for continuously exerting a biasing force on the lid in a direction away from the base so as to position the lid in the partially open position.

10. The portable computer as recited in claim 9 wherein the base side locking mechanism comprises a catch, wherein the lid side locking mechanism comprises a latch, and wherein the latch and the catch work together to hold the lid closed against the biasing force exerted by the spring element.

11. The portable computer as recited in claim 10 wherein the latch is movably coupled to the lid, and wherein the catch is movably coupled to the base.

12. The portable computer as recited in claim 11 wherein the catch comprises a magnetic element for causing the latch to lockably engage the catch when the lid is moved to the closed position.

13. A portable computer comprising:

a base having a catch disposed therein, the catch being movable relative to and pivotally mounted to the base;

a lid pivotally mounted to the base, the lid being movable between a closed position, placing the lid substantially flush with the base, and an open position, placing the lid away from the base, the lid having a retractable latch disposed therein, the retractable latch being movable relative to and pivotally mounted to the lid, wherein the retractable latch automatically moves between a first latch position, hiding the latch within the lid when the lid is moved to the open position, and a second latch position, engaging the catch when the lid is moved to the closed position, and wherein the catch moves between a first catch position, engaging the latch to prevent movement of the lid relative to the base, and a second catch position, releasing the latch therefrom to permit movement of the lid & relative to the base.

14. The portable computer as recited in claim 13 wherein the latch pivots in a first plane, and wherein the catch pivots in a second plane that is different than the first plane.

15. The portable computer as recited in claim 13 wherein a first spring element is used to continuously exert a first biasing force on the latch so as to place the latch in the first latch position, and wherein a second spring element is used to continuously exert a second biasing force on the catch so as to place the catch in the first catch position.

16. The portable computer as recited in claim 15 wherein the magnetic force is produced by a magnetic element disposed within the base.

17. The portable computer as recited in claim 16 wherein the magnetic element is coupled to the catch, and wherein the magnetic element magnetically draws the latch towards the catch when the latch is proximate the catch.

18. The portable computer as recited in claim 13 wherein a magnetic force is used to move the latch from the first latch position to the second latch position.

19. The portable computer as recited in claim 13 wherein the catch includes a release button attached thereto for moving the catch from the first catch position to the second catch position.

20. The portable computer as recited in claim 19 wherein the release button protrudes from a side of the catch and extends into a hole positioned in a side of the base.

21. A locking mechanism for locking first and second housings of a computer device together, comprising:

a latch that is rotatably coupled to the first housing about a first rotational axis; and a catch that is rotatably coupled to the second housing about a second rotational axis, the second rotational axis being transverse to the first rotational axis, the latch being configured to rotate about the first rotational axis in order to lockably engage with the catch, the catch being configured to rotate about the second rotational axis in order to releasably disengage the latch therefrom.

22. A computer device, comprising:

a first housing;

a second housing movable relative to the first housing; and a locking system for mechanically securing the second housing relative to the first housing, the locking system including a latch that is movable relative to the second housing and that is magnetically forced into clasping engagement with a portion or component of the first housing to mechanically secure the second housing relative to the first housing, the locking system including a magnetic element disposed within the first housing and a catch that is movable relative to the first housing, the magnetic element being configured to magnetically draw the latch of the second housing into clasping engagement with the catch of the first housing to mechanically secure the second housing relative to the first housing, the catch being disposed in its entirety within the first housing.

* * * * *